US006386223B1

(12) United States Patent
Hoeptner, III

(10) Patent No.: US 6,386,223 B1
(45) Date of Patent: May 14, 2002

(54) BACK FLOW PREVENTING VALVE APPARATUS, WITH MULTIPLE CHECK VALVES

(76) Inventor: Herbert W. Hoeptner, III, 7796 Oak Springs Cir., Gilroy, CA (US) 95020

( * ) Notice: Subject to any disclaimer, the term of this patent is extended or adjusted under 35 U.S.C. 154(b) by 0 days.

(21) Appl. No.: 09/691,470

(22) Filed: Oct. 17, 2000

(51) Int. Cl.[7] ..... E03C 1/10
(52) U.S. Cl. ..... 137/218; 137/360
(58) Field of Search ..... 137/218, 360

(56) References Cited

U.S. PATENT DOCUMENTS 3,155,107 A * 11/1964 Woodford ..... 137/218
4,286,616 A * 9/1981 Botnick ..... 137/218 X
5,228,471 A * 7/1993 Hoeptner ..... 137/218
5,752,542 A * 5/1998 Hoeptner ..... 137/218
5,813,428 A * 9/1998 Almasy et al. ..... 137/218

* cited by examiner

*Primary Examiner*—Gerald A. Michalsky
(74) *Attorney, Agent, or Firm*—William W. Haefliger

(57) ABSTRACT

A safety valve apparatus body defining a flow chamber having a side outlet, a control adjustable to move lengthwise in the chamber, a first valving part carried by the control and movable to advance and retract relative to a second valve part on the body, thereby to provide a first check valve to block reverse flow of fluid through the chamber, and a second check valve proximate the outlet to pass forward fluid flow from the chamber and to block reverse flow of fluid to the chamber, via the side outlet.

10 Claims, 7 Drawing Sheets

BACK FLOW PREVENTING VALVE APPARATUS, WITH MULTIPLE CHECK VALVES

BACKGROUND OF THE INVENTION

This invention relates generally to valves usable to deliver water from housing or building plumbing lines. More particularly, it concerns improvements to such valves, simplifying their construction, and enhancing their performance.

There is need in such valves for improvements associated with blocking or checking back flow where reverse flow pressure may build up. Also, there is need in such valves for separating the built-up back flow pressure, from the potable water supply as during checking or blocking of such back flow to the building plumbing. Such back flow, if unchecked, could contaminate water in that plumbing. There is also need for such separation in the form of a chamber, or air gap, between two check valves, to ensure against cross-contamination between a potable water supply and a source of back pressure.

The existing hydrants rely on a single check valve as the only barrier between pressure that can develop in a supply duct, such as a hose, with no potable water, and a potable water supply. If and when that single check valve fails, possibly contaminated water in the hose will flow into the potable water supply.

SUMMARY OF THE INVENTION

It is a major object of the invention to provide an improved, compact, simple, highly effective back flow preventing valving assembly, meeting the above need. Basically, the assembly includes:

a) a body defining a flow chamber having a side outlet, b) a control adjustable to move lengthwise in the chamber, c) a first valving part carried by the control and movable to advance and retract relative to a second valve part on the body, thereby to provide a first check-valve to block reverse flow of fluid through the chamber, d) and a second check-valve located proximate the side outlet to pass forward fluid flow from the chamber, and to block reverse flow of fluid to the chamber, via that side outlet.

Further objects include the location of the control such as a rod in the chamber to project toward said first check valve, the second check valve sidewardly offset from the rod and the rod being movable to advance and retract in response to turning of a handle in opposite directions; provision of a flow chamber side extension sidewardly offset from the rod, the second check valve located in that chamber side extension; and first and second body portions which are interconnected, the first body portion carrying the first check valve, and the second body portion carrying the second check valve.

Yet another object includes provision of the second check valve to comprise tubular body structure having main passage structure between flow entrance and exit ports; the body structure having a port communicating with the passage structure; first and second diaphragms carried by the body structure to be exposed to flow in the passage structure; the second diaphragm being typically movable to allow in-flow of air through a side port when a stopper and the first diaphragm block back flow of fluid through the main passage structure.

An additional object is to provide a safety valve apparatus that includes:

a) first and second valving assemblies, each including a check valve, b) the first valving assembly having a primary side which is an inlet side to which potable water is supplied, and a secondary side, c) the second valve assembly having a primary side, and a secondary side which is a discharge side to which back pressure may be supplied, d) and a barrier chamber communicating between said first assembly discharge side and said second assembly primary side, for blocking cross-contamination between potable water at said first assembly primary side, and liquid at said second assembly secondary side.

DRAWING DESCRIPTION

Figure 1:
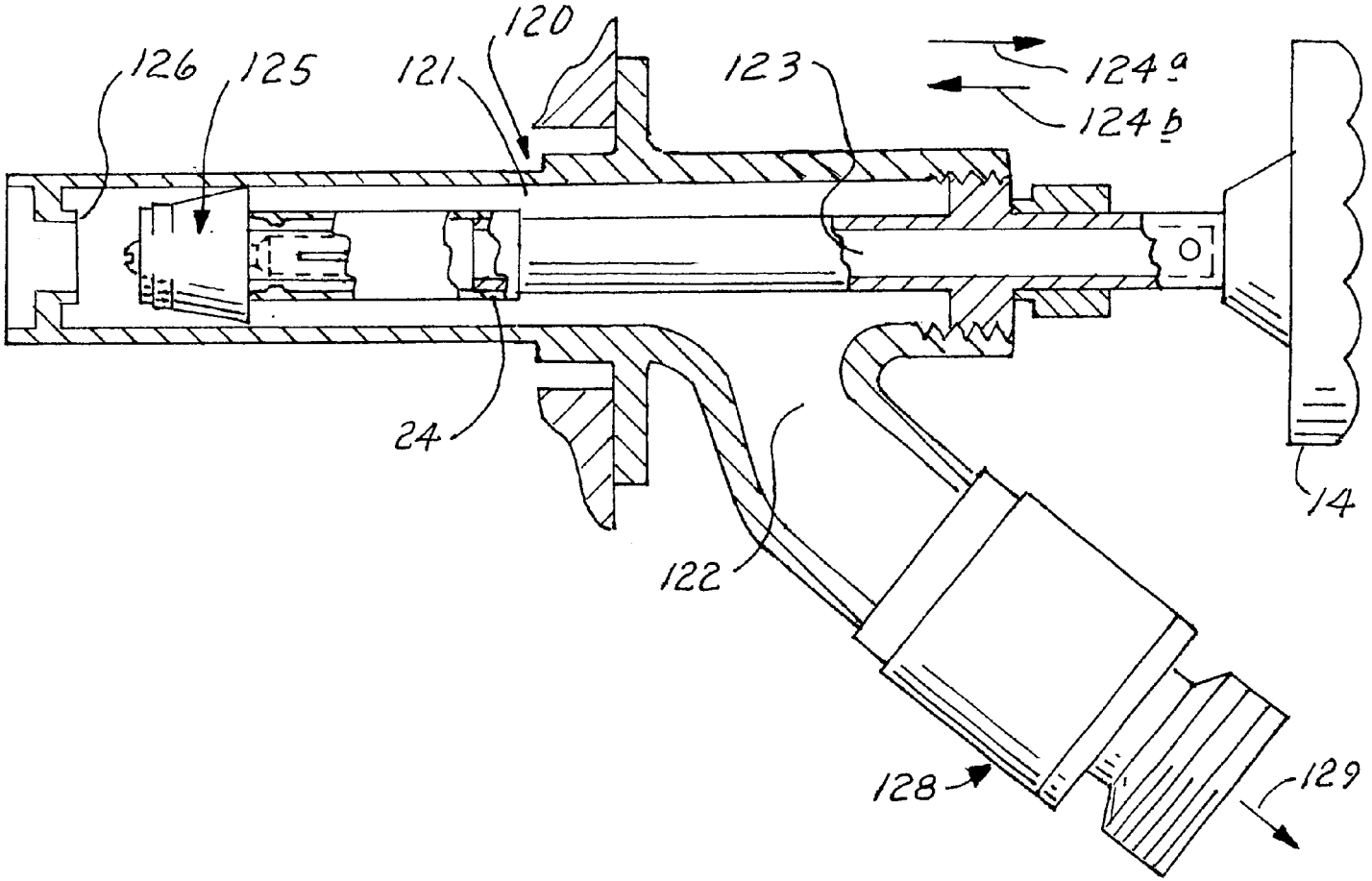
FIG. 1 is a schematic side view of apparatus incorporating the invention.
Figure 2:
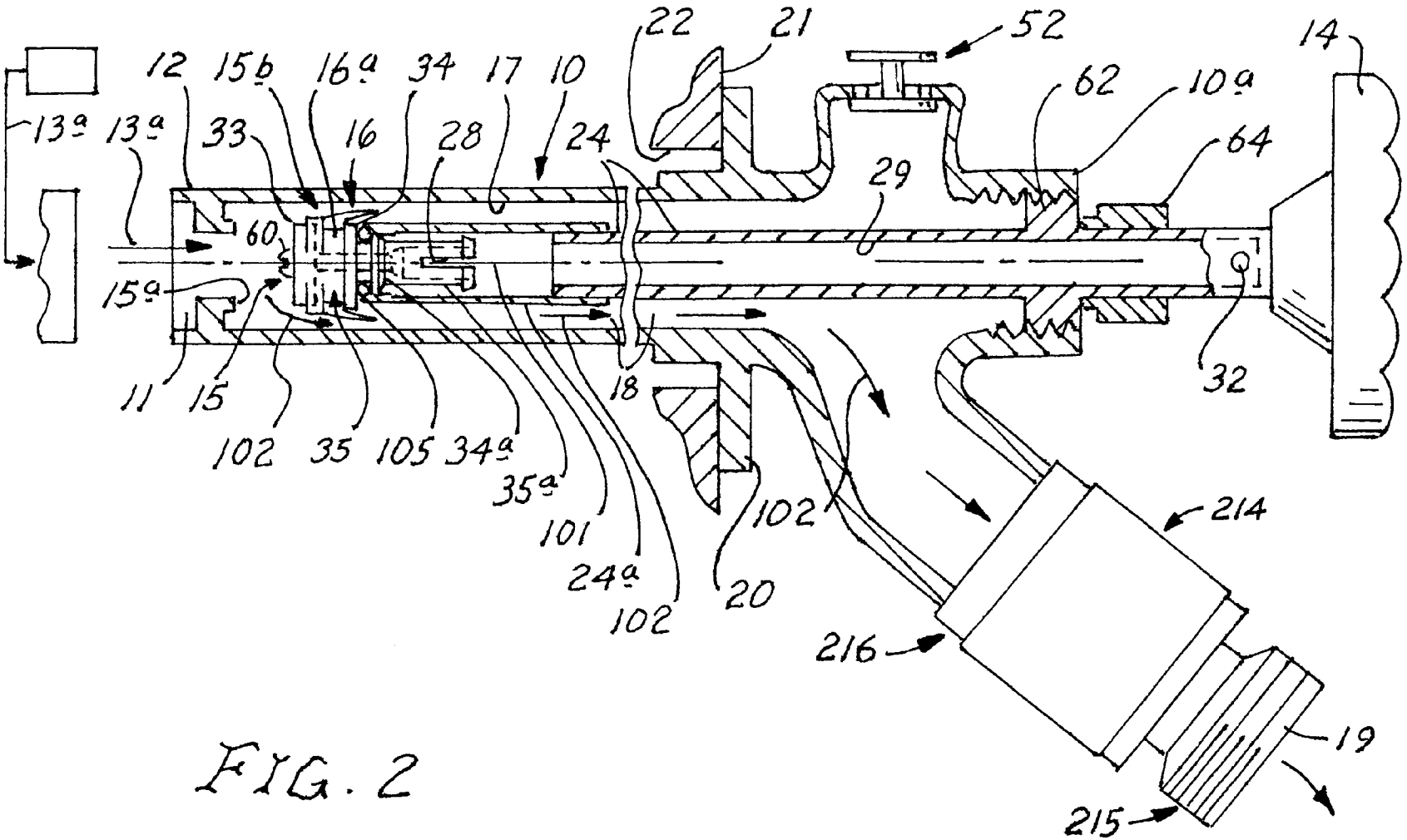
FIG. 2 is a view like FIG. 1, but taken in section to show internal construction, the valve being OPEN.
Figure 2A:
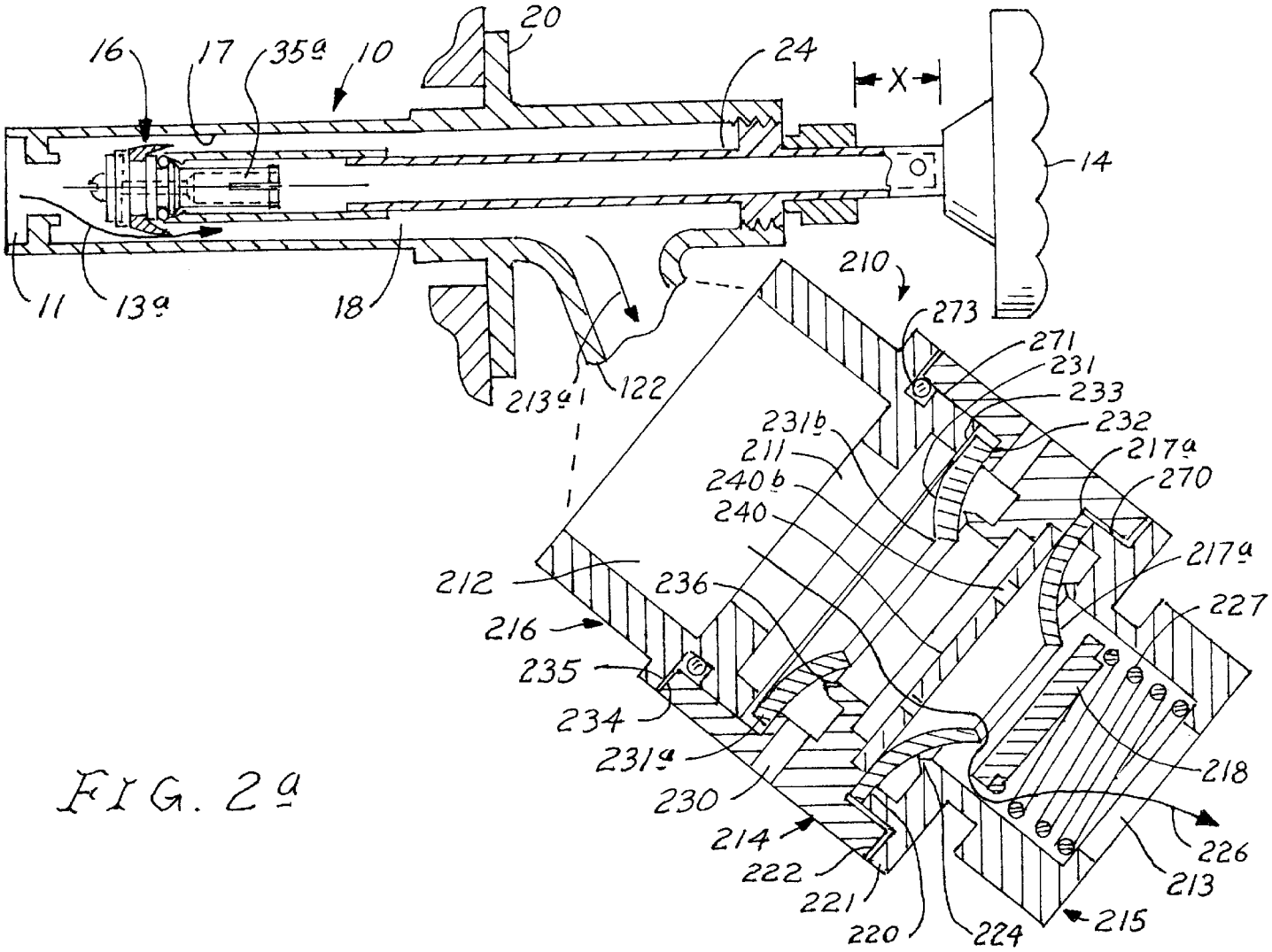
Figure 3:
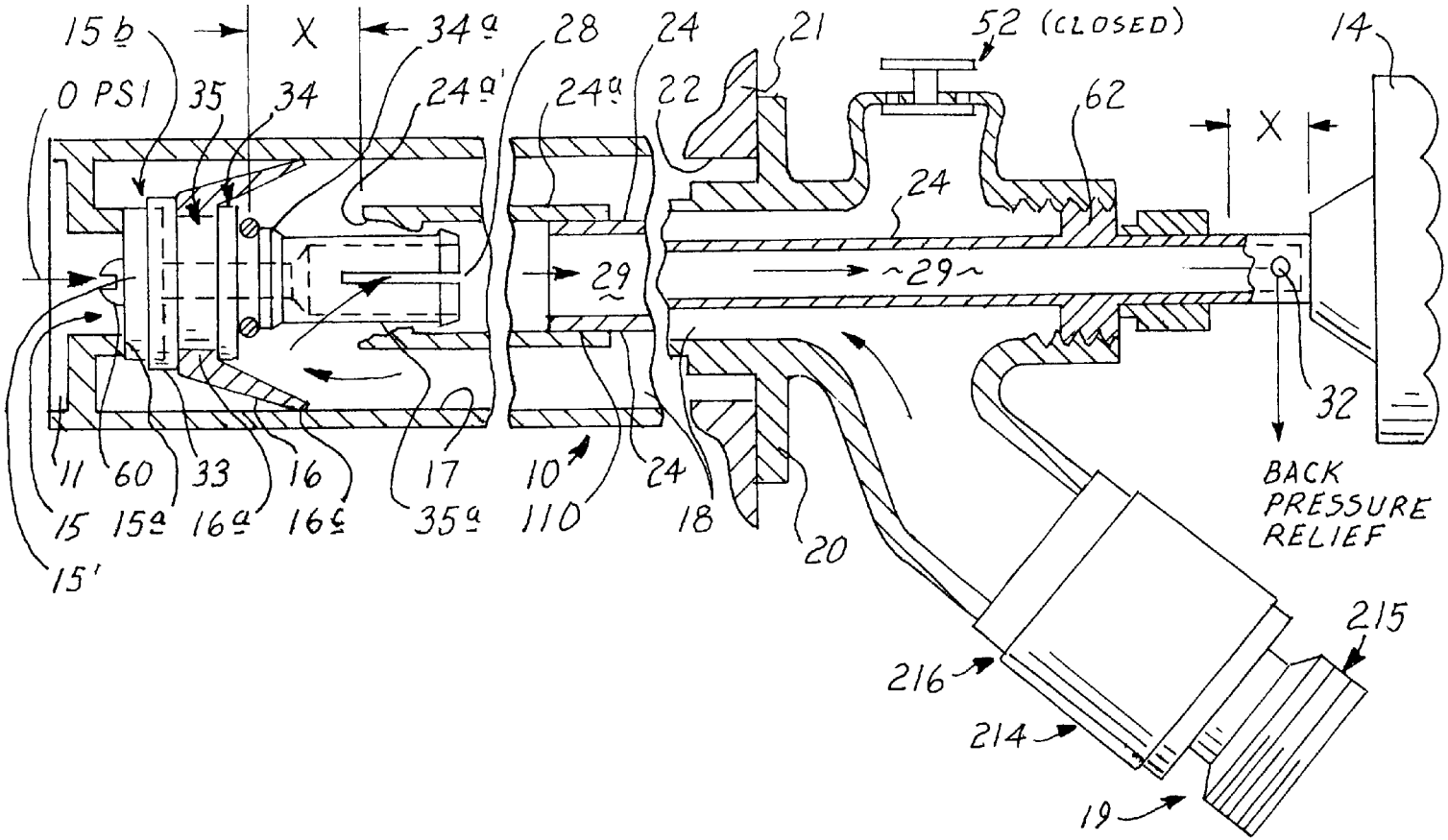
Figure 3A:
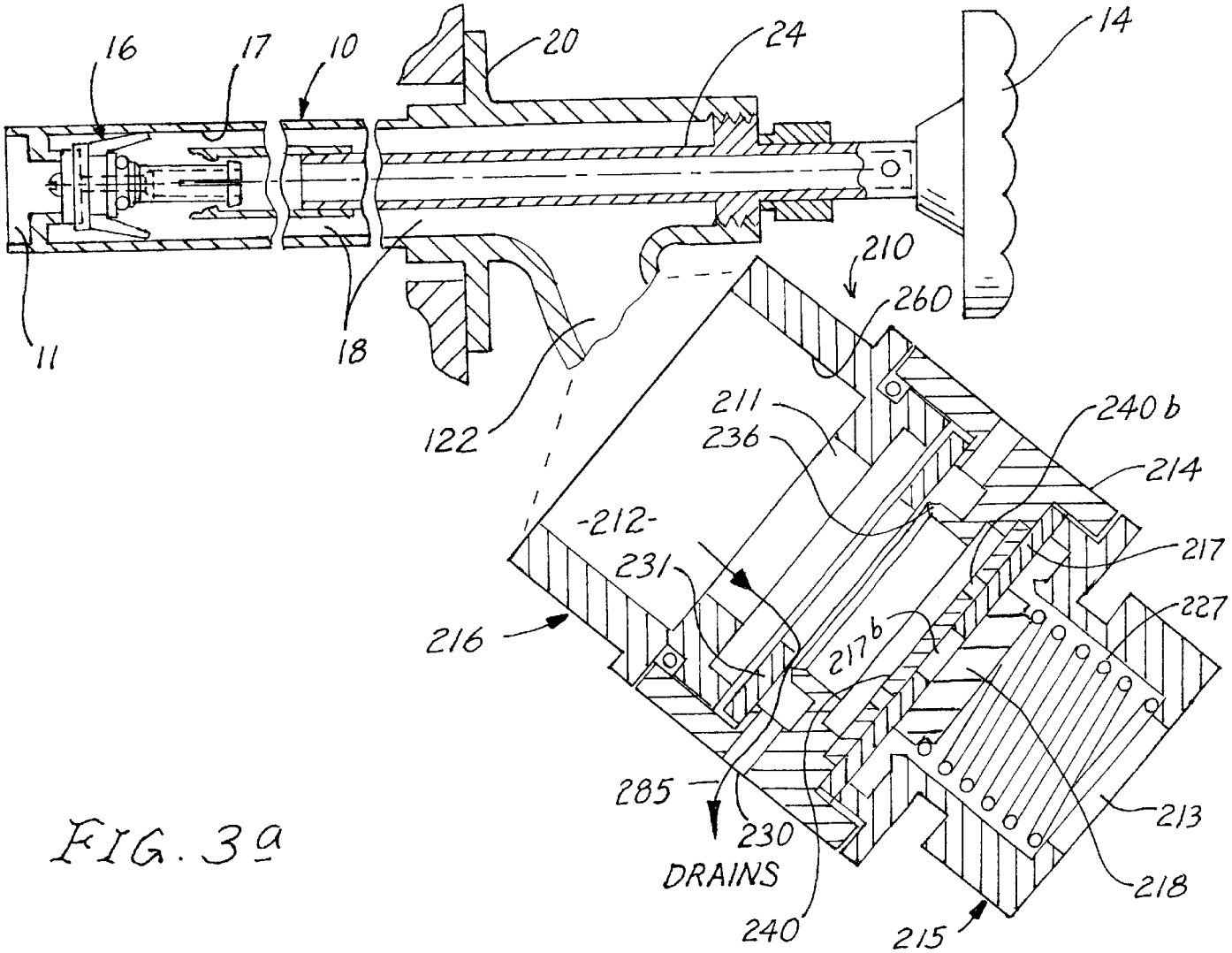
Figure 4:
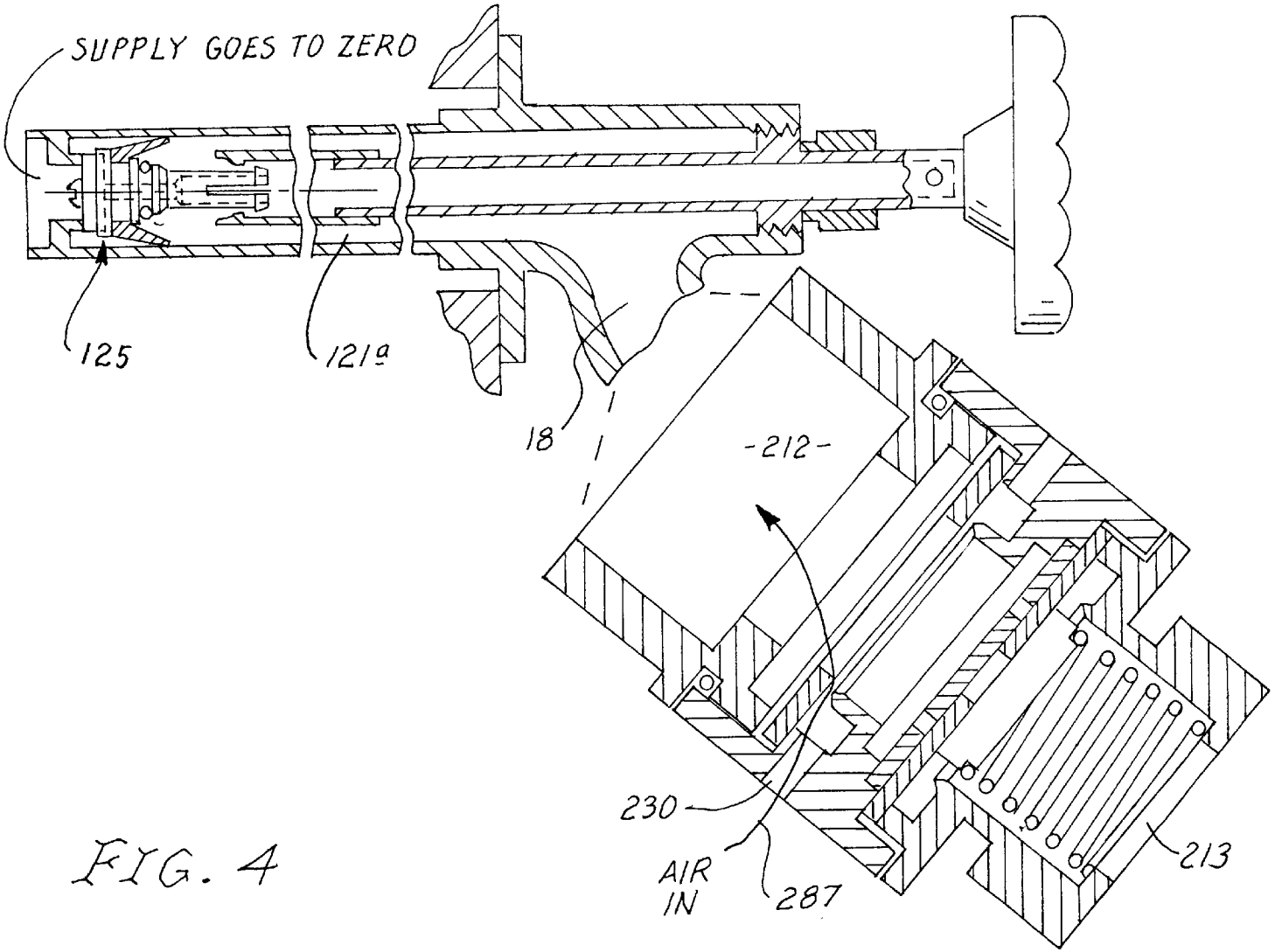
Figure 5:
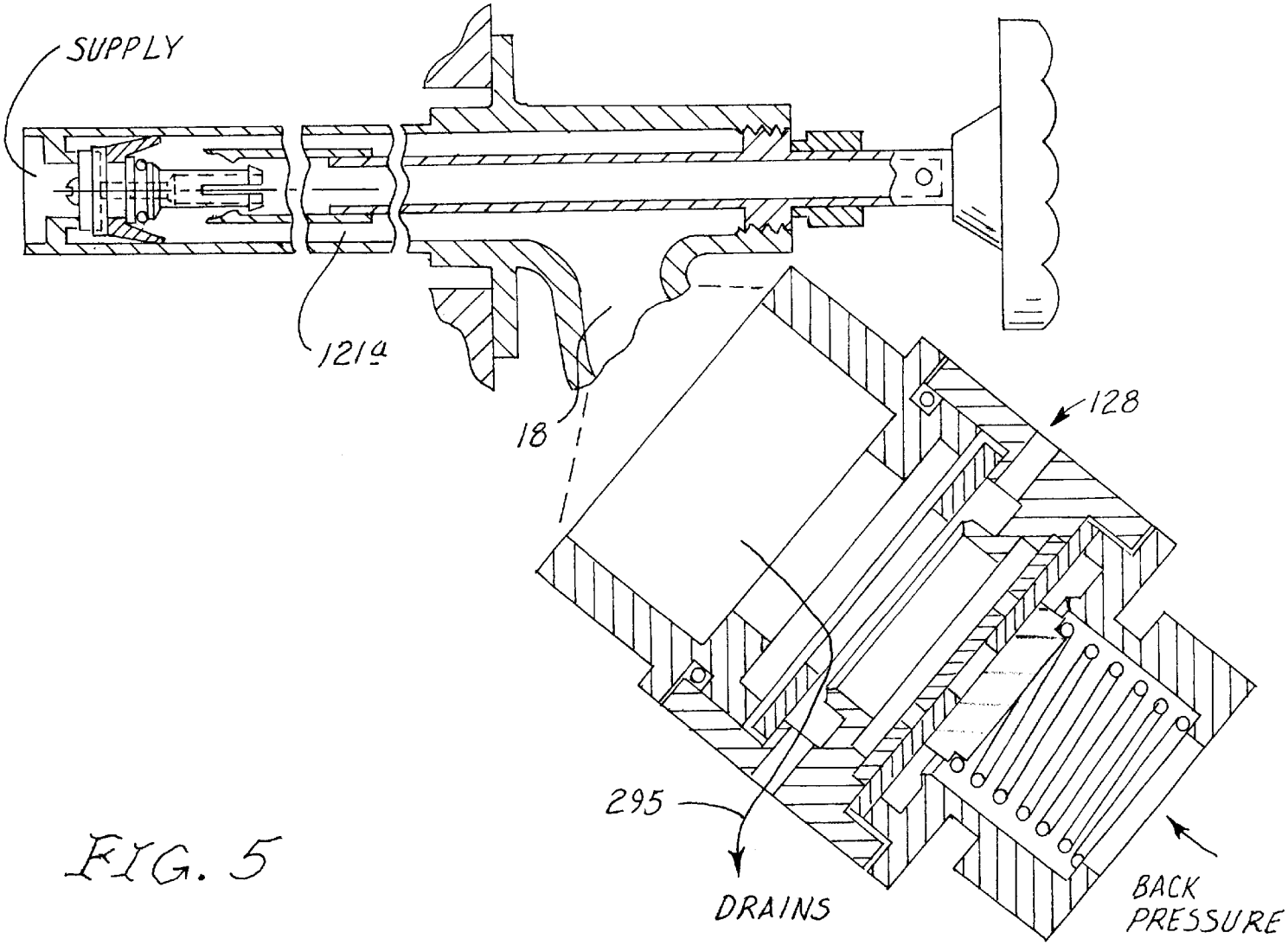

FIG. 2*a* is a section taken through a second check valve in OPEN mode;

FIG. 3 is a view like FIG. 2, the valve being ON;

FIG. 3*a* is a view like FIG. 2*a*, but showing a drainage condition, both check valves being in non-failing condition;

FIG. 4 is a view like FIG. 1, but showing a back siphonage condition when a first check valve is failing; and FIG. 5 is a view like FIG. 1, but showing a back pressure exceeding supply pressure condition, when a second check valve is failing.

DETAILED DESCRIPTION

Referring first to FIG. 1, it shows a preferred assembly, that includes:

a) a body 120 defining a flow chamber 121 having a side outlet 122, chamber 121 also serving as a barrier chamber;

b) a control such as a rod 123 adjustable to move lengthwise in the chamber, in directions 124*a* and 124*b;* c) a first valving assembly including a part 125 (for example a stopper) carried by the rod and movable to advance and retract relative to a second valving part 126 (for example a seat) on the body, thereby to provide a first check valve to block reverse flow of fluid through the chamber; and d) a second valving assembly including a check valve 128 proximate outlet 122 to pass forward fluid flow in direction 129 from the chamber 121, and to block reverse flow of fluid to the chamber, via that side outlet.

In FIG. 2, showing in a more detailed example an "ON" condition of the first valve and in FIG. 3, showing an "ON" condition, of that detailed example, an outer tubular member as at 10 has a first flow port 11 at one end of the member. A fitting 12 at that end is adapted to receive a pipe end 13 to which water pressure is communicated at 13*a*, typically at about 60 PSI. When a control such as valve handle 14 is rotated in one direction, a closure such as a first valve stopper or plug 15 is backed away from a seat 15*a* in member 10, allowing pressurized water from 13 to flow past check valve 16, in bore 17, and then to flow via chamber or space 18 to fitting 19, as for delivering water from plumbing in a residence. See FIG. 2. A flange 20 on the member 10 is engageable with a wall 21 of the building, to position member 10 in a bore 22 in that wall. Check valve 16 may be considered as a first check valve, or valve assembly.

The closure assembly 15*b* is carried by an elongated inner member 24, which in its leftward advanced position, is urged against the seat 15*a*. In rightward retracted position of the valve of FIG. 2, the member 15*b* is spaced from the port 11 to open the latter, allowing flow of water as at 102.

Auxiliary check valve 16 is shown as annular, to be positioned about the axis 101 of inner member 24. It is configured to deflect and to pass the flow rightwardly, as referred to above (see flow arrows 102 in FIG. 2), and to block reverse fluid flow (back-flow) from space 18 leftwardly past the check valve and to and through first port 11, as in FIG. 3 ON position. Thus, potentially contaminating back flow as from a hose via fitting 19 to port 11 is prevented. In this regard, handle OFF position is seen in FIG. 4; and handle ON position is seen in FIGS. 2 and 3.

A relief port may be provided, as at 32, to pass back-flow fluid from space 18, as in FIG. 3, to aid in relieving build-up of pressure of fluid in that space. As shown in FIG. 3, port 32 is provided by an axially extending slot 28 in the side wall of a tubular stem extension 35*a* of a body 35 that carries 16. Stem extension 35*a* slides telescopically in a sleeve extension 24*a* of tubular member 24. As seen in FIG. 3. Fluid in passage 18 flows via slot 28 into the elongated bore or passage 29 in 24. Fluid may escape from the passage 29 as via a side relief port 32 near handle 14. Port 32 leads to the exterior. Port or slot 28 is not exposed to space 18 when flow from first port 11 passes rightwardly past the check valve as in FIG. 2, i.e. port 28 is then covered, since extension 35*a* is then retracted rightwardly by flow pressure into sleeve extension 24*a* on 24. See FIG. 2. However, if backpressure builds up in space 18, as in FIG. 3, check valve 16 is then pushed to the left, uncovering the port 28, to allow escape or relief of backpressure to space 18. In FIG. 3 stopper 15 has sealed against seat 15*a*.

Note in this regard the positioning of the check valve inner annular body 16*a* between two flanges 33 and 34 on axially movable body 35 that carries closure to stopper 15 at the leftward end of body 35. Body 35 carries an O-ring 105 between flange 34 and flange 34*a*, to seat at tapered seat end 24*a*' of extension 24*a*, as in FIG. 3, thereby isolating slot 28 from passage 18. As shown in FIG. 2, pressurized drain flow cannot escape via slit port 28 to the bore 29 of member 24. However, when back-flow pressure dominates (in open condition of the valve handle as in FIG. 3), it forces valve 16 to the left, carrying body 35 to the left, and slit port 28 then becomes exposed to passage 18, due to travel of O-ring 105 leftwardly away from the tapered seat end of sleeve 24*a*. Back flow pressure can then be relieved via slit port 28 and bore 29 to the exterior.

Note that check valve 16 has a frusto-conical annular lip 16*a* with an edge wiping annularly against bore 17, when moved to FIG. 3 position. No spring is required to move valve 16 leftwardly.

A fastener 60 is shown extending axially to retain a stopper 15 plate 15' to flange 33 of assembly 15*b*, allowing its replacement, after a threaded plug 62 is removed from the rightward barrel end 10*a* of 10. A nut 64 on 62 allows such plug removal. Plug 62 is integral with 24 to threadably engage 10*a* for advancing and retracting 24 as the handle is turned.

In FIGS. 2*a* and 3*a*, showing the highly advantageous form of the second check valve or valve assembly as at 128 in FIG. 1, a tubular body means 210 has main through passage structure 211 between entrance and exit ports 212 and 213. The direction of forward fluid flow is indicated by arrow 213*a* in FIG. 2*a*. By way of example, the tubular body means may advantageously comprise a first tubular section 214, a second tubular section 215 and a third tubular section 216; and such sections may be axially assembled in telescoping relation, as in the manner shown. The flow sequence is from 216 to 214 to 215.

A first flexible diaphragm 217 is carried by the body means 214 and 215 to be exposed to flow in the passage means 212. Also, a stopper 218 is provided in the passage means to cooperate with the first diaphragm to pass forward fluid flow while the first diaphragm flexes forwardly, as seen in FIG. 2*a* showing the ON condition. As shown, the first diaphragm is annular and may have its outer annular extent 217*a* retained between annular shoulder 219 formed by the first body section 214 and annular shoulder 220 formed by the second section 215. Flange 221 on the second section engages a rim 222 on the first section to limit closing of shoulder 220 toward shoulder 219 when the diaphragm is forcibly retained between its shoulders. Threads 270 may interconnect 214 and 215.

Note that the second body section 215 has a annular seat 224 thereon presented toward the diaphragm and positioned to annularly seat the first diaphragm as it flexes. Under these conditions, flow passes through the diaphragm central opening 217*b*, then around the periphery of the stopper 218 and then outwardly through the exit port 213. See arrow 226. Flow pressure against the stopper displaces it to allow such flow to pass through central opening 217*b* in diaphragm 217, a compression spring 227 in the second section 215 exerting return force on the stopper. That spring is compressed as the stopper is forced to FIG. 2*a* position by flow pressure.

The body means also has a second side port or ports 230 for communicating with the interior passage structure 211, as shown in FIG. 3*a*. Under these conditions, the port or ports 230 act to pass fluid out of passage 211, second diaphragm 231 flexing away from annular seat 236 to allow such out-flow. The second diaphragm is seated on seat 236, to block exit flow through the second side port or ports 230 in response to the described flow of fluid through the main passage means, this condition being shown in FIG. 2*a*. Note that the second diaphragm outer annular extent 231*a* may be captivated between opposed shoulders 232 on the first body section and 233 on the third body section in such manner as to allow the described flexing or movement of the second diaphragm. Interengaged shoulders 234 and 235 of the sections 214 and 216 limit closure of shoulders 232 and 233 to captivate the second diaphragm. Threading at 271 removably connects 214 and 216. See also annular seal 273.

The stopper 218 cooperates with the first diaphragm 217 to block back flow of fluid through the main passage when the first diaphragm moves in FIG. 3*a* to block and hold back flow or back pressure of fluid. In this regard, a metallic disc 240 or equivalent support is provided in the body means to extend normal to the flow, and to support the first diaphragm 217. The spring 227 then urges the stopper 218 to engage the side 217*a*' of the diaphragm 217, closing or blanking its central opening 217*b*, and thereby forcing the diaphragm against the disc 240. The central portion of the disc then extends across the diaphragm central opening 217*b* to block the escape of fluid through that opening and the diaphragm blanks escape through disc opening or openings 240*b*. When the diaphragm is displaced, as in FIG. 2*a*, flow passes through disc opening or openings 240*b* spaced radially outwardly of, or about, the disc central portion. See flow arrow 226. Note also that the second annular diaphragm has a central opening 231*b* to pass such flow, in FIG. 2*a* and to pass air in FIG. 3*a*.

In FIG. 3*a* the second diaphragm 231 is shown as having moved off the seat 236.

The two diaphragms are spaced apart lengthwise of the passage so that they may flex independently. Each of the diaphragms is annular and has its outer periphery retained in fixed position relative to the body, the latter having disconnectible sections to provide ready access to the diaphragms for removal and replacement. In this regard, while the sections may have threaded interconnections at 270 and 271, other forms of connection may be provided. Also, the stopper is movable in the passage free of both of said diaphragms, and in spaced relation thereto.

Forward flow of fluid is allowed without sideward discharge. In the event of attempted back flow, the FIG. 3*a* configuration is assumed and back flow is held. This is in addition to the action of the first check valve 125 to block reverse flow, whereby a redundant provision against back flow to the water mains is provided. The positions of the elements at rest when there is no forward flow are shown in FIG. 3*a*. Threaded connections may be provided internally at 260 for connection to chamber outlet duct 122. Note drainage path indicated by arrow 285.

FIG. 4 shows the positions of the elements, as during a back-siphonage condition. For example, supply pressure may go to zero. The intermediate chamber shown at 121*a* then sucks air in (see arrow 287) via port 230, as for example when the first valve assembly 125 fails. Stopper 218 holds, as in FIG. 3*a*, to close off back flow from 213 to 212 and to 121*a*.

FIG. 5 shows the position of the elements, as during valve ON condition when back fluid pressure exceeds supply fluid pressure, with the intermediate chamber 121*a* draining, at 295. If the second check valve 128 fouls, the chamber 121*a* continues to drain.

I claim:

1. In safety valve apparatus:

a) a body defining a flow chamber having a side outlet, and a side duct in series with said outlet, b) a control adjustable to move lengthwise in the chamber, c) a first valving part carried by the control and movable to advance and retract relative to a second valve part on the body, thereby to provide a first check valve to block reverse flow of fluid through the chamber, d) and a second check valve carried by said side duct and having a configuration to pass forward fluid flow from the chamber, to block reverse flow of fluid to the chamber, via said side outlet, and to block escape of such reverse flow past the second check valve and then to the exterior of said body.

2. The apparatus of claim 1 wherein said control includes a rod that projects in the chamber toward said first check valve, the second check valve sidewardly offset from the rod.

3. The apparatus of claim 2 including a handle on the rod projecting outside said chamber, the rod connected with the body to advance and retract in response to turning of the handle in opposite directions.

4. The combination of claim 1 wherein the second check valve comprises tubular body structure having main passage structure between flow entrance and exit ports; the body structure having a side port communicating with the passage structure; first and second diaphragms carried by the body structure to be exposed to flow in the passage structure; a stopper in the passage structure cooperating with the first diaphragm to pass forward fluid flow, and to block and hold back flow of fluid through the main passage structure when back fluid pressure exceeds supply fluid pressure.

5. The combination of claim 4 wherein the second diaphragm is configured for movement to allow in-flow of air through side port when the stopper and first diaphragm block back flow of fluid through the main passage structure, said side port also operable to serve as a drain in the event of OFF condition, the second diaphragm having an annular lip to provide such movement.

6. In safety valve apparatus, the combination comprising:

a) first and second valving assemblies, each including a check valve, b) the first valving assembly having a primary side which is an inlet side to which potable water is supplied, and a secondary side, c) the second valving assembly having a primary side, and a secondary side which is a discharge side to which back pressure may be supplied, d) and a barrier chamber communicating between said first assembly discharge side and said second assembly primary side, for blocking cross-contamination between potable water at said first assembly primary side, and liquid at said second assembly secondary side, e) an actuator extending endwise in said chamber, for adjusting said first valving assembly, there being a side duct communicating with said chamber, the second valving assembly carried by said side duct, f) the second valving assembly including a first valving diaphragm, and wall structure at all times blocking by-pass flow of said liquid past the diaphragm and escape to the exterior of the second valving assembly.

7. The combination of claim 6 where the side duct also extends sidewardly of the actuator.

8. The combination of claim 6 wherein the second valving assembly includes:

i) a second diaphragm for controlling flow through the assembly, ii) the assembly including a body having a drain port communicating with a body passage between the two diaphragms.

9. The combination of claim 8 wherein the two diaphragms are in series with said side duct communicating with said chamber.

10. The combination of claim 9 wherein the first valving assembly includes valving parts carried by the actuator.

* * * * *